US009085135B2

(12) United States Patent
Fujii et al.

(10) Patent No.: US 9,085,135 B2
(45) Date of Patent: Jul. 21, 2015

(54) SEMICONDUCTOR DEVICE, LIQUID DISCHARGE HEAD, LIQUID DISCHARGE HEAD CARTRIDGE, AND PRINTING APPARATUS

(71) Applicant: CANON KABUSHIKI KAISHA, Tokyo (JP)

(72) Inventors: Kazunari Fujii, Tokyo (JP); Hiroaki Kameyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/066,824

(22) Filed: Oct. 30, 2013

(65) Prior Publication Data

US 2014/0132655 A1 May 15, 2014

(30) Foreign Application Priority Data

Nov. 9, 2012 (JP) ..... 2012-247750

(51) Int. Cl.
*B41J 29/38* (2006.01)
*B41J 2/045* (2006.01)

(52) U.S. Cl.
CPC ..... *B41J 2/04548* (2013.01); *B41J 2/0458* (2013.01); *B41J 2/04581* (2013.01)

(58) Field of Classification Search
CPC ..... B41J 2/04541; B41J 2/04548
USPC ..... 347/9
See application file for complete search history.

(56) References Cited

U.S. PATENT DOCUMENTS 4,171,989 A * 10/1979 Pryor ..... 136/256
5,144,447 A * 9/1992 Akimoto et al. ..... 348/301
6,604,066 B1 * 8/2003 Hatsuda ..... 703/19
6,794,674 B2 * 9/2004 Kusumoto ..... 327/524
7,262,480 B2 * 8/2007 Kyogoku et al. ..... 257/531
8,562,111 B2 10/2013 Fujii
8,807,708 B2 8/2014 Fujii
2010/0244102 A1 9/2010 Kusumoto
2011/0148990 A1 * 6/2011 Miyazawa et al. ..... 347/68
2011/0292105 A1 * 12/2011 Fujii ..... 347/9
2014/0002549 A1 1/2014 Fujii

FOREIGN PATENT DOCUMENTS

CN 1483208 A 3/2004
CN 102259492 A 11/2011
JP 2006-326972 A 12/2006

OTHER PUBLICATIONS

Office Action in Chinese Patent Application No. 201310551695.8, dated Feb. 27, 2015.

* cited by examiner

*Primary Examiner* — Alessandro Amari
*Assistant Examiner* — Michael Konczal
(74) *Attorney, Agent, or Firm* — Fitzpatrick, Cella, Harper & Scinto

(57) ABSTRACT

A semiconductor device for controlling discharge of a liquid includes a power supply terminal, a ground terminal, driving portions arranged along a straight line between the power supply terminal and the ground terminal to discharge a liquid, a power supply line extending along the straight line from the power supply terminal to supply a power supply voltage to the driving portions, and a ground line extending along the straight line from the ground terminal to supply a ground voltage to the driving portions. A width of the power supply line in a direction perpendicular to the straight line continuously or gradually decreases away from the power supply terminal, and a width of the ground line in the direction continuously or gradually decreases away from the ground terminal.

12 Claims, 10 Drawing Sheets

SEMICONDUCTOR DEVICE, LIQUID DISCHARGE HEAD, LIQUID DISCHARGE HEAD CARTRIDGE, AND PRINTING APPARATUS

BACKGROUND OF THE INVENTION

1. Field of the Invention

The present invention relates to a semiconductor device, liquid discharge head, liquid discharge head cartridge, and printing apparatus.

2. Description of the Related Art

There is an inkjet printing head that causes a bubble generation phenomenon in a liquid by giving it thermal energy generated by a heater, and discharges an ink droplet from an orifice by energy for generating a bubble. Recently, the number of orifices has been increased in order to realize a high printing speed. On the other hand, variations in resistances of heaters between the ground and the power supply have increased, and this makes it difficult to supply the same electric power to the heaters. As a measure to cope with this problem, Japanese Patent Laid-Open No. 2006-326972 describes an arrangement in which a power supply line connecting portion for connecting a power supply line for supplying electric power to a heater to the outside and a ground line connecting portion for connecting a ground line to the outside are arranged on different edges of a substrate.

In this arrangement described in Japanese Patent Laid-Open No. 2006-326972, however, flowing electric currents increase toward the power supply line connecting portion and ground line connecting portion. Accordingly, voltage drop amounts increase toward the power supply line connecting portion and ground line connecting portion. This may increase variations in voltage to be applied to heaters for discharging ink.

SUMMARY OF THE INVENTION

The present invention provides a technique advantageous for reducing variations in voltage to be applied to a plurality of driving portions for discharging a liquid.

The first aspect of the present invention provides a semiconductor device configured to control discharge of a liquid, the device comprising: a power supply terminal; a ground terminal; a plurality of driving portions arranged along a straight line between the power supply terminal and the ground terminal and configured to operate for discharging a liquid; a power supply line extending along the straight line from the power supply terminal and configured to supply a power supply voltage to the plurality of driving portions; and a ground line extending along the straight line from the ground terminal and configured to supply a ground voltage to the plurality of driving portions, wherein a width of the power supply line in a direction perpendicular to the straight line continuously or gradually decreases away from the power supply terminal within a range in which the plurality of driving portions are arranged, and a width of the ground line in the direction continuously or gradually decreases away from the ground terminal within the range.

The second aspect of the present invention provides a liquid discharge head comprising: an orifice configured to discharge a liquid; and the semiconductor device as defined as the first aspect of the present invention and arranged to control the discharge of the liquid from the orifice.

The third aspect of the present invention provides a liquid discharge head cartridge comprising: the liquid discharge head as defined as the second aspect of the present invention; and a tank configured to hold a liquid supplied to the liquid discharge head.

The fourth aspect of the present invention provides a printing apparatus comprising the liquid discharge head cartridge as defined as the third aspect of the present invention.

Further features of the present invention will become apparent from the following description of exemplary embodiments with reference to the attached drawings.

DESCRIPTION OF THE EMBODIMENTS

Figure 1:
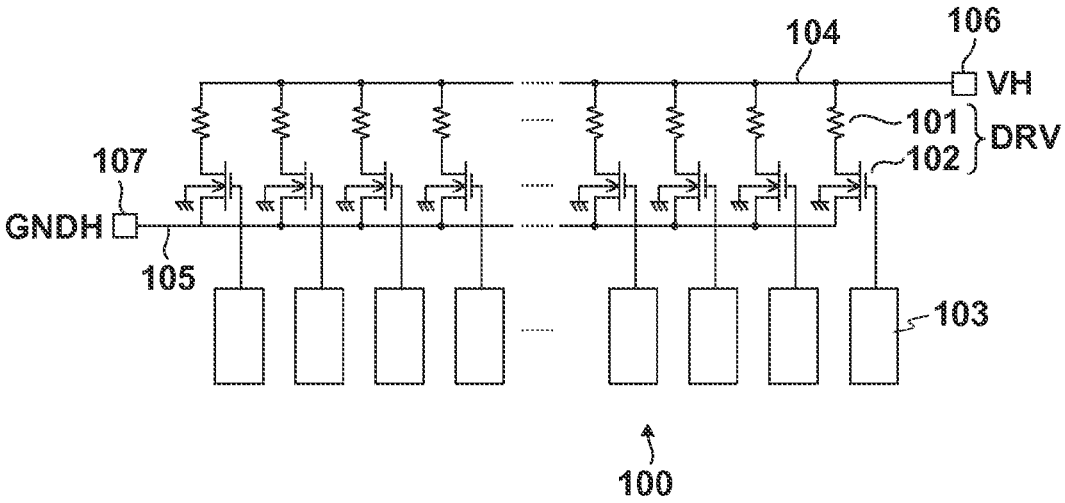
FIG. 1 is a view showing the circuit configuration of a semiconductor device of the first embodiment of the present invention.

A semiconductor device as the first embodiment of the present invention will be explained below. FIG. 1 shows the circuit configuration of a semiconductor device 100 of the first embodiment. The semiconductor device 100 is configured to control the discharge of a liquid. For example, the semiconductor device 100 can be configured to control the discharge of a liquid such as ink from an orifice in a printing apparatus that prints an image on a medium such as paper by using the liquid.

The semiconductor device 100 includes a power supply terminal (VH terminal) 106, a ground terminal (GNDH) 107, a plurality of driving portions DRV, a power supply line (VH line) 104, and a ground line (GNDH line) 105. The semiconductor device 100 can include a plurality of control circuits (typically, logic circuits) 103 for controlling the plurality of driving portions DRV. Each driving portion DRV can include an energy applying unit 101 for applying energy to a liquid such as ink so as to discharge the liquid from an orifice, and a driving element 102 for driving the energy applying unit 101. The energy applying unit 101 can be, for example, a heater or piezo element. The driving element 102 can be a circuit element for controlling the application of electric energy to the energy applying unit 101. The driving element 102 can be a transistor capable of controlling an electric current, for example, a power transistor. FIG. 1 exemplarily shows an NMOS transistor as the driving element 102.

Figure 2:
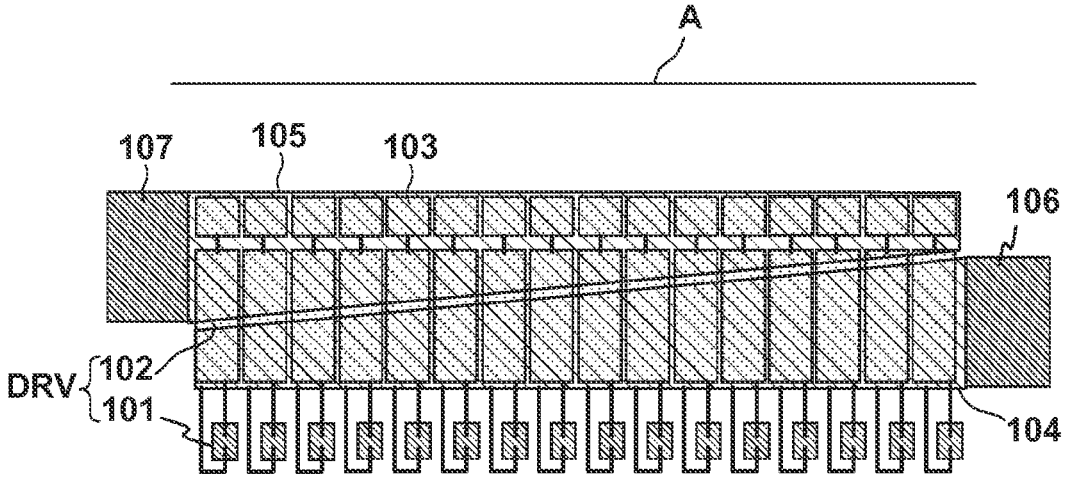
FIG. 2 is a view showing the layout of the semiconductor device of the first embodiment of the present invention.

FIG. 2 shows the layout of the semiconductor device 100 of the first embodiment of the present invention. The semiconductor device 100 is typically formed on a semiconductor substrate such as a silicon substrate by using a multilayer wiring technique. The plurality of driving portions DRV are arranged along a straight line A between the power supply terminal 106 and ground terminal 107. The plurality of control circuits 103 are also arranged along the straight line A between the power supply terminal 106 and ground terminal 107.

The power supply line 104 is, for example, a metal line (which can be made of a metal such as an aluminum alloy) of a second layer, and can be formed to extend over the driving elements 102. The power supply line 104 extends along the straight line A from the power supply terminal 106, and applies a power supply voltage to the plurality of driving portions DRV. The ground line 105 is a metal line (which can be made of a metal such as an aluminum alloy), and can be formed to extend over the control circuits 103. The ground line 105 extends along the straight line A from the ground terminal 107, and applies a ground voltage to the plurality of driving portions DRV. The power supply line 104 and ground line 105 typically have a predetermined thickness. The power supply terminal 106 is arranged on one side of the array of the plurality of driving portions DRV, and the ground terminal 107 is arranged on the other side of the array of the plurality of driving portions DRV.

Within the range in which the plurality of driving portions DRV are arranged, the width of the power supply line 104 in a direction perpendicular to the straight line A continuously or gradually decreases away from the power supply terminal 106. Likewise, within the range in which the plurality of driving portions DRV are arranged, the width of the ground line 105 in the direction perpendicular to the straight line A continuously or gradually decreases away from the ground terminal 107. The sum total of the width of the power supply line 104 in the direction perpendicular to the straight line A and the width of the ground line 105 in the direction perpendicular to the straight line A is typically constant.

Figure 3:
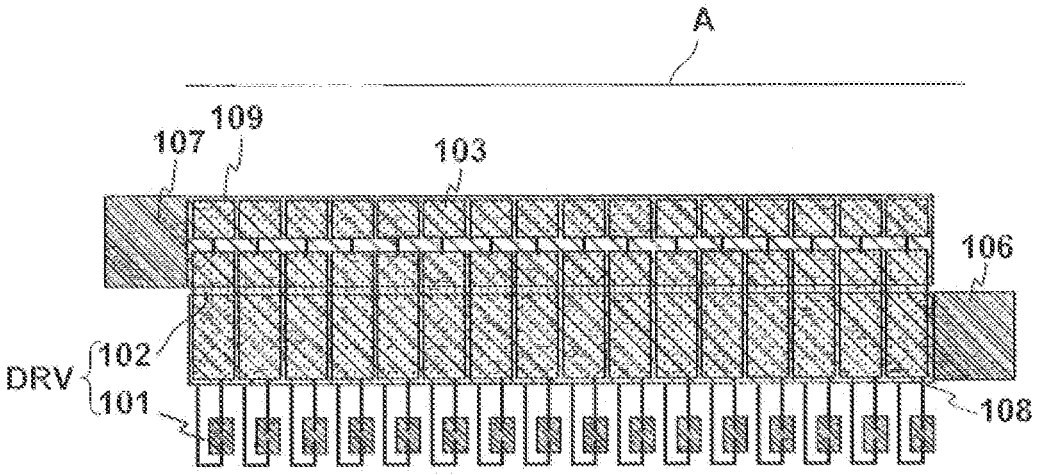
Prior Art FIG. 3
FIG. 3 is a view showing a comparative example for the first embodiment of the present invention.

FIG. 3 shows a comparative example for the first embodiment. A driving portion DRV including an energy applying unit 101 and driving element 102, a control circuit 103, a power supply terminal 106, and a ground terminal 107 are the same as those shown in FIG. 2. This comparative example differs from the first embodiment shown in FIG. 2 in that the width of each of a power supply line 108 and ground line 109 in the direction perpendicular to the straight line A is constant.

To compare the characteristics of the power supply line 104 of the first embodiment shown in FIG. 2 with those of the power supply line 108 of the comparative example shown in FIG. 3, the specifications of the power supply line and ground line will exemplarily be described below. In the exemplary specifications, the wiring resistance of the power supply lines 104 and 108 and ground lines 105 and 109 is 0.1 Ω/□, an electric current flowing through each energy applying unit 101 is 0.1 A, the arrangement intervals between the energy applying units 101 is 50 μm, and the total number of the energy applying units 101 is 16. Also, in the exemplary specifications, the power supply line 104 has a trapezoidal shape having a line width (a width in the direction perpendicular to the straight line A, the same shall apply hereinafter) of 150 μm on the side of the power supply terminal 106, a line width of 100 μm in the central portion, and a line width of 50 μm on the side of the ground terminal 107. The power supply line 108 has a rectangular shape having a line width of 100 μm.

Of the plurality of driving portions DRV, the driving portion DRV arranged in a position farthest from the power supply terminal 106 has the largest voltage drop amount at a power supply side terminal (a drop amount from the voltage of the power supply terminal 106). Also, this voltage drop amount at the power supply side terminal of the driving portion DRV arranged in the position farthest from the power supply terminal 106 is largest when electric currents are supplied to all of the 16 driving portions DRV. In the following description, the voltage drop amount at the power supply side terminal of the driving portion DRV arranged in the position farthest from the power supply terminal 106 when electric currents are supplied to all of the 16 driving portions DRV will be called a maximum voltage drop amount. The maximum voltage drop amount in the power supply line 104 of the first embodiment is 0.62 V, and that in the power supply line 108 of the comparative example is 0.68 V. Thus, the maximum voltage drop amount in the power supply line 104 of the first embodiment is reduced to 91.2% of that in the power supply line 108 of the comparative example.

The ground line 105 of the first embodiment and the ground line 109 of the comparative example will be compared below under the above-described exemplary specifications. Of the plurality of driving portions DRV, the driving portion DRV arranged in a position farthest from the ground terminal 107 has the largest voltage rise amount at a ground side terminal (a rise amount from the voltage of the ground terminal 107). Also, this voltage rise amount at the ground side terminal of the driving portion DRV arranged in the position farthest from the ground terminal 107 is largest when electric currents are supplied to all of the 16 driving portions DRV. In the following description, the voltage rise amount at the ground side terminal of the driving portion DRV arranged in the position farthest from the ground terminal 107 when electric currents are supplied to all of the 16 driving portions DRV will be called a maximum voltage rise amount. The maximum voltage rise amount in the ground line 105 of the first embodiment is 0.62 V, and that in the ground line 109 of the comparative example is 0.68 V. Thus, the maximum voltage rise amount in the ground line 105 of the first embodiment is reduced to 91.2% of that in the ground line 109 of the comparative example.

In the first embodiment as described above, it is possible to reduce voltage fluctuations caused by the wiring resistance without changing the area occupied by the power supply line and ground line.

Referring to FIGS. 2 and 3, the power supply line and power supply terminal are close to each other, and the ground line and ground terminal are close to each other, so voltage fluctuations caused by a line between the power supply line and power supply terminal and a line between the ground line and ground terminal are negligible. If the power supply line and power supply terminal are spaced apart from each other and/or the ground line and ground terminal are spaced apart from each other, the power supply line and power supply terminal and/or the ground line and ground terminal are preferably connected by a line having as low a resistance as possible. However, the same effect as that of the first embodiment can be obtained in this case as well.

Figure 4:
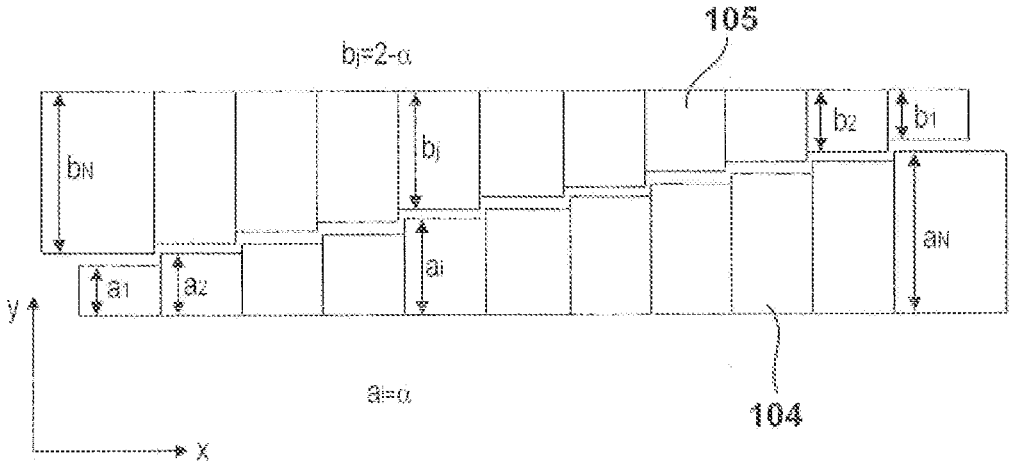
FIG. 4 is a view for explaining a power supply line and ground line according to the first embodiment of the present invention.

Next, a practical method of determining the line width will exemplarily be explained. FIG. 4 shows the power supply line 104 and ground line 105. Although not shown, the right end of the power supply line 104 is connected to the power supply terminal 106, and the left end of the ground line 105 is connected to the ground terminal 107. Referring to FIG. 4, an X direction and a Y direction perpendicular to the X direction are defined. The X direction is parallel to the above-described straight line A.

The power supply line 104 is evenly divided into N power supply line blocks arranged along the X direction, and these blocks are given numbers from 1 to N from the side of the ground terminal 107. "Evenly divided" herein mentioned means that the N power supply line blocks have the same width in the X direction. In FIG. 4, the leftmost power supply line block is the first power supply line block, and the rightmost power supply line block is the Nth power supply line block. Let $a_i$ be the width (line width) in the Y direction of the ith power supply line block from the ground terminal 107. Note that i is an integer of 1 to N. Similarly, the ground line 105 is evenly divided into N ground line blocks arranged along the X direction, and these blocks are given numbers from 1 to N from the side of the power supply terminal 106. "Evenly divided" herein mentioned means that the N ground line blocks have the same width in the X direction. In FIG. 4, the rightmost ground line block is the first ground line block, and the leftmost ground line block is the Nth ground line block. Let $b_j$ be the width (line width) in the Y direction of the jth ground line block from the side of the power supply terminal 106. Note that j is an integer of 1 to N. Also, as is apparent from FIG. 4, the N power supply line blocks and N ground line blocks are arranged such that the ith power supply line block and (N+1−i)th ground line block are adjacent to each other.

In the following explanation, the line width of the central one of the plurality of power supply line blocks is 1, and the line widths of other power supply line blocks are represented by the ratios to the line width of the central power supply line block. Also, the line width of the central one of the plurality of ground line blocks is 1, and the line widths of other ground line blocks are represented by the ratios to the line width of the central ground line block.

Under the above-mentioned conditions, the line width $a_i$ of each power supply line block arranged between the ground terminal and central power supply line block preferably satisfies:

$$1+(i-j)/(i+j)<a_i<1 \quad (1)$$

where i+j=N+1.

The line width $a_i$ of each power supply line block arranged between the central power supply line block and power supply terminal preferably satisfies:

$$1<a_i<1+(i-j)/(i+j) \quad (2)$$

The line width $b_j$ of each ground line block arranged between the ground terminal and the central ground line block preferably satisfies:

$$1<b_j<1+(-i+j)/(i+j) \quad (3)$$

The line width $b_j$ of each ground line block arranged between the central ground line block and the power supply terminal preferably satisfies:

$$1+(-i+j)/(i+j)<b_j<1 \quad (4)$$

A method of deriving expressions (1) to (4) will be explained below. The ground side terminal of the ith driving portion DRV to which a voltage is applied from the ith power supply line block is connected to the (N+1−i)th ground line block. That is, j=N+1−i holds. In the following explanation, the power supply lines 104 and 108 and ground lines 105 and 109 will be evaluated by the sum (total voltage drop amount) of the voltage drop amount in the ith power supply line block and the voltage drop amount (the voltage rise amount when based on the ground level) in the jth ground line block.

The sum total of the line widths of the ith power supply line block and jth ground line block is 2. Letting α be the line width of the ith power supply line block, the line width of the jth ground line block is 2−α.

Since the sheet resistance of the power supply lines 104 and 108 and ground lines 105 and 109 is constant, the resistance of the power supply lines 104 and 108 and ground lines 105 and 109 is proportional to the reciprocal of the line width. Also, the voltage drop amount in the power supply lines 104 and 108 and ground lines 105 and 109 is proportional to (electric current)/(line width). Letting I be an electric current flowing through one driving portion DRV, an electric current flowing through the ith power supply line block is i×I, and an electric current flowing through the jth ground line block is j×I.

In the comparative example shown in FIG. 3, if the line width of each of the ith power supply line block and jth ground line block is 1, a total voltage drop amount V1 in the ith power supply line block connected to the ith driving portion DRV and in the jth ground line block is expressed by:

$$V1=(i\times I)/1+(j\times I)/1=(i+j)\times I \quad (5)$$

In the first embodiment shown in FIG. 4, a total voltage drop amount V2 in the ith power supply line block connected to the ith driving portion DRV and in the jth ground line block is expressed by:

$$V2=(i\times I)/\alpha+(j\times I)/(2-\alpha)=(i/\alpha+j/(2-\alpha))\times I \quad (6)$$

The first embodiment and comparative example will be compared by the ratio of V2 to V1 as indicated by:

$$V2/V1=(i/\alpha+j/(2-\alpha))/(i+j) \quad (7)$$

The range within which V2/V1 is lower than 1 is the range within which the total voltage drop amount in the first embodiment is lower than that in the comparative example. Expressions (1) to (4) are obtained by calculating this range.

Figure 5:
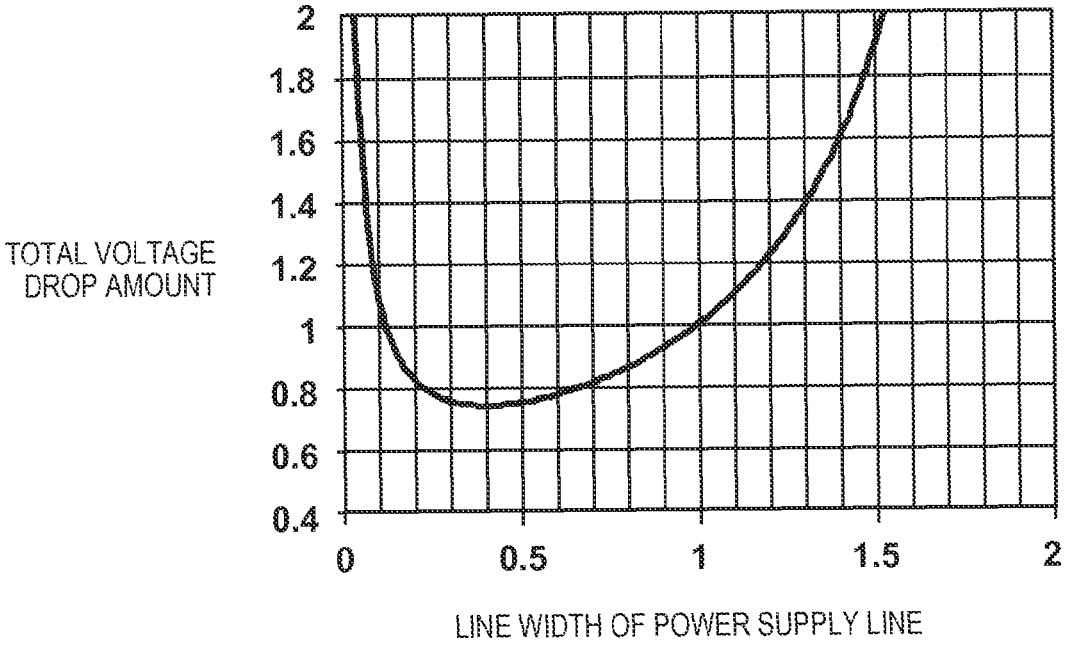
FIG. 5 is a graph exemplarily showing the relationship between the line width of the power supply line and the total voltage drop amount of the power supply line and ground line.
Figure 6:
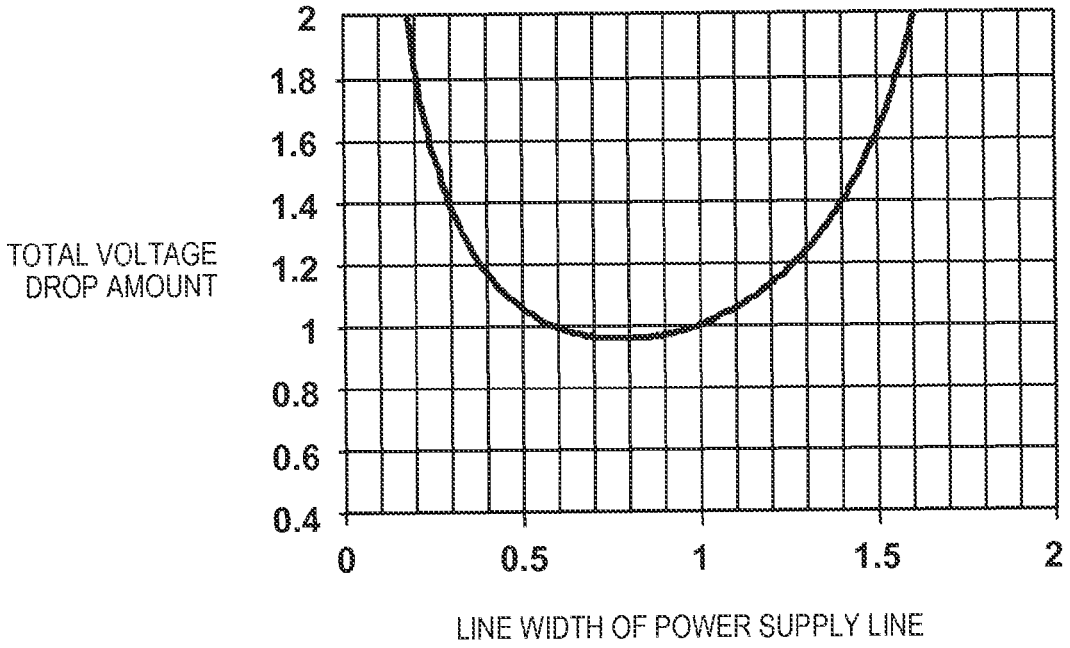
FIG. 6 is a graph exemplarily showing the relationship between the line width of the power supply line and the total voltage drop amount of the power supply line and ground line.
Figure 7:
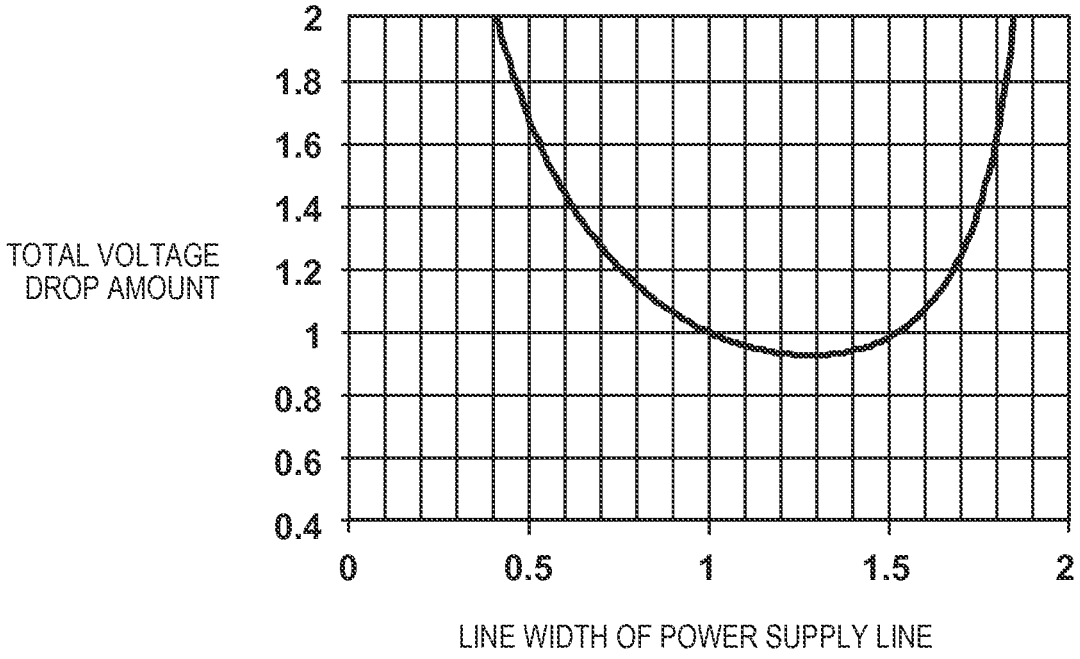
FIG. 7 is a graph exemplarily showing the relationship between the line width of the power supply line and the total voltage drop amount of the power supply line and ground line.
Figure 8:
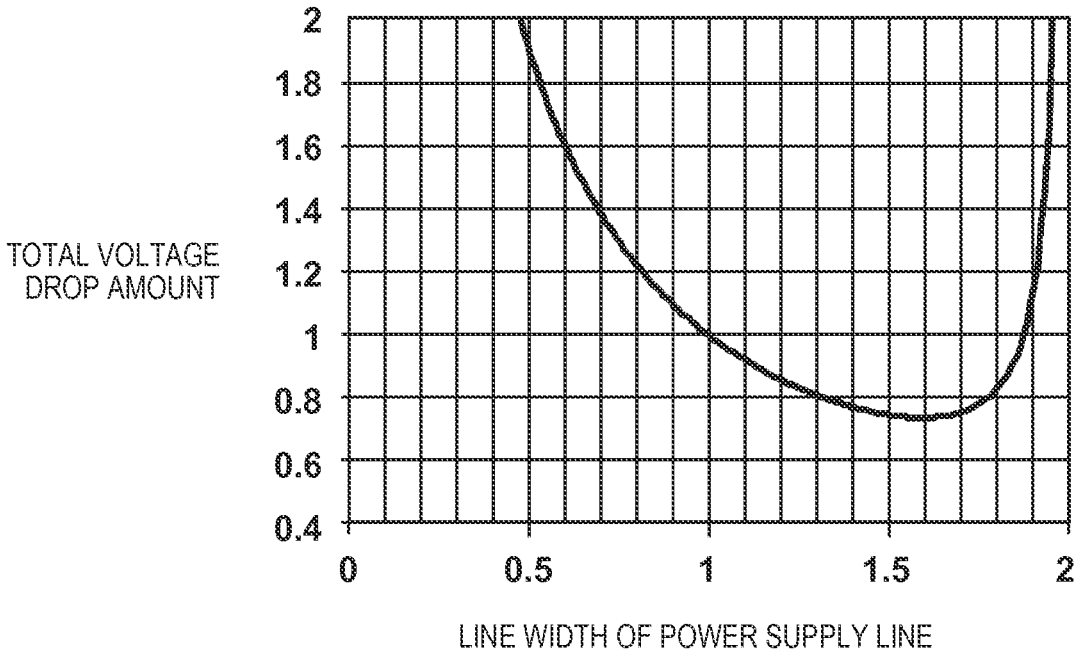
FIG. 8 is a graph exemplarily showing the relationship between the line width of the power supply line and the total voltage drop amount of the power supply line and ground line.

FIG. 5 shows the total voltage drop amount in the first embodiment when N=16 and i=1. FIG. 6 shows the total voltage drop amount in the first embodiment when N=16 and i=5. FIG. 7 shows the total voltage drop amount in the first embodiment when N=16 and i=12. FIG. 8 shows the total voltage drop amount in the first embodiment when N=16 and i=16. Note that the line width of the power supply line 108 and ground line 109 of the comparative example is 1 as described previously. Note also that the line width of the central one of the plurality of power supply line blocks of the first embodiment is 1, and the line width of the central one of the plurality of ground line blocks of the first embodiment is 1. The range within which the total voltage drop amount is less than 1 (the range within which expression (1) is met) in FIGS. 5 and 6 is the range within which the effect of reducing the total voltage drop amount more than that in the comparative example is obtained. The range within which the total voltage drop amount is less than 1 (the range within which expression (2) is met) in FIGS. 7 and 8 is the range within which the effect of reducing the total voltage drop amount more than that in the comparative example is obtained.

Figure 9:
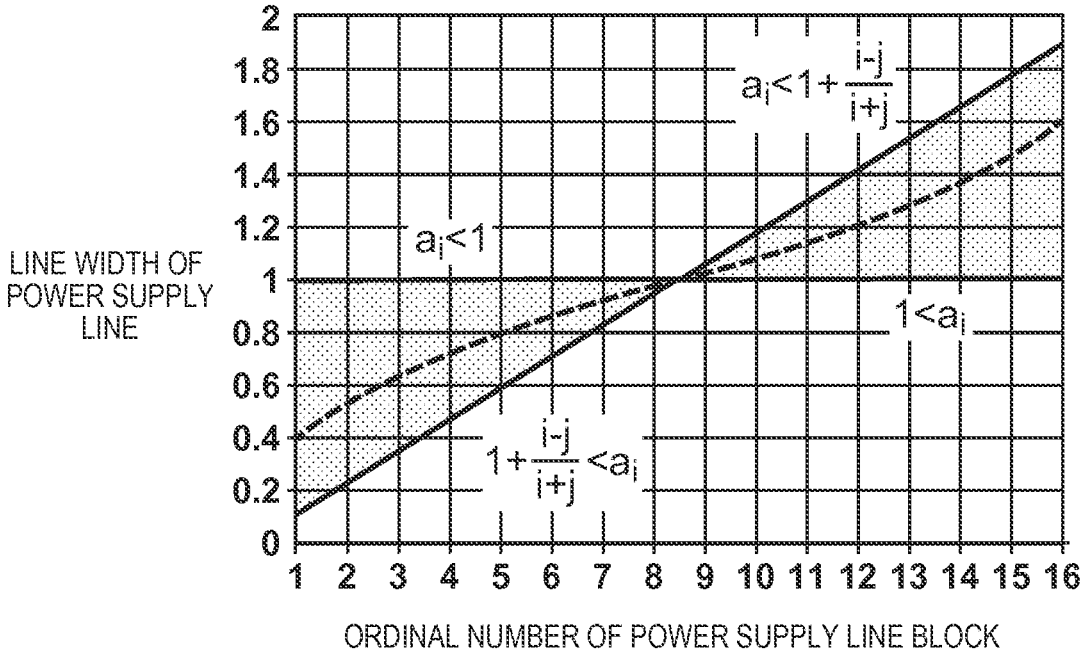
FIG. 9 is a view for explaining the effect of reducing the total voltage drop amount of the power supply line and ground line.

FIG. 9 shows the range within which the total voltage drop amount reducing effect is obtained when N=16. The abscissa indicates i, and the ordinate indicates the line width ($\alpha=a_i$) of the power supply line 104. The ranges indicated by expressions (1) and (2) are represented by the halftone in FIG. 9. The dotted line in FIG. 9 is the line width that maximizes the total voltage drop amount reducing effect, and this is indicated by:

$$a_i=(i+j-\sqrt{(4\times i\times j)})/(i-j)+1 \quad (9)$$

The maximum value of the total voltage drop amount can be reduced to 91.0% of that of the comparative example by making the line width ($a_i$) of the power supply line 104 equal to the line width given by equation (9).

Similarly, the line width ($b_j$), which maximizes the total voltage drop amount reducing effect, of the ground line 105 is given by:

$$b_j=(i+j-\sqrt{(4\times i\times j)})/(-i+j)+1 \quad (10)$$

The line width $a_i$ can be the representative value (for example, the average value) of the line width of the ith power supply line block of the power supply line 104. Analogously, the line width $b_j$ can be the representative value (for example, the average value) of the line width of the jth ground line block of the ground line 105. That is, the power supply line 104 and ground line 105 need not have a staircase shape as exemplarily shown in FIG. 4, and can have, for example, a trapezoidal shape.

In the above-mentioned example, N=16, and the number of driving portions DRV is 16. However, the printing speed and printing accuracy can be improved by increasing the number of driving portions DRV. When the number of driving portions DRV is increased, the voltage fluctuation caused by the wiring resistance of the power supply line and ground line increases, so the effect of the first embodiment more significantly appears.

Also, the number (N) of divisions need only be 2 or more, but is preferably equal to the number of driving portions DRV. When a plurality of driving portions DRV form a segment and there are a plurality of segments, the number (N) of divisions is preferably equal to the number of segments.

Figure 10:
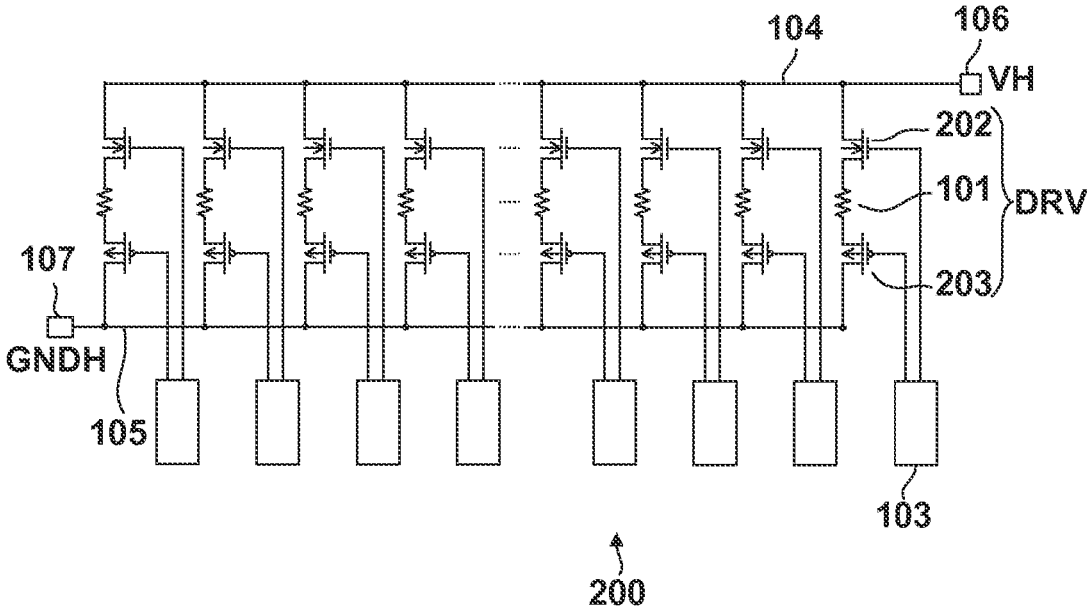
FIG. 10 is a view showing the circuit configuration of a semiconductor device of the second embodiment of the present invention.
Figure 11:
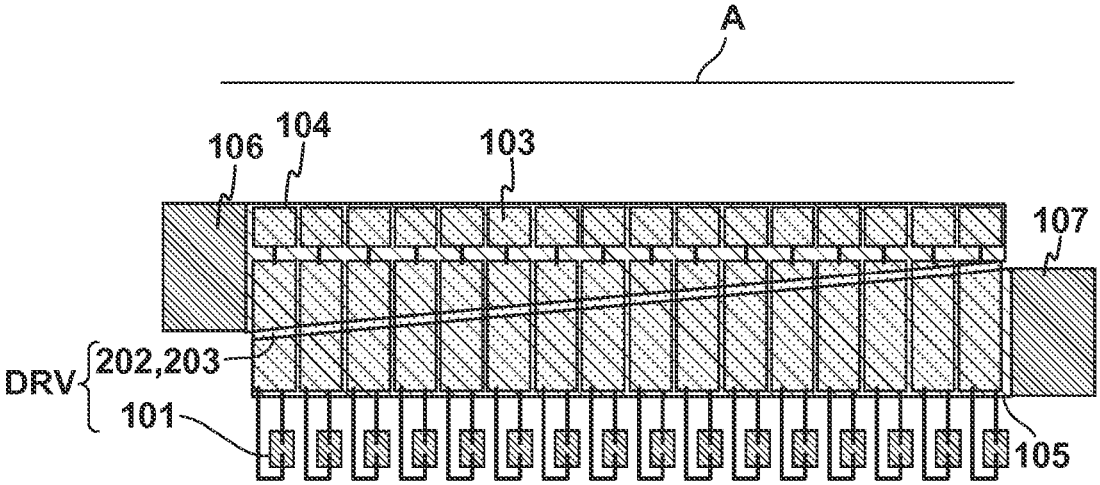
FIG. 11 is a view showing the layout of the semiconductor device of the second embodiment of the present invention.

FIG. 10 shows the circuit configuration of a semiconductor device 200 of the second embodiment. In the second embodiment, only differences from the first embodiment will be explained. In the second embodiment, a driving portion DRV includes an energy applying unit 101 and driving elements 202 and 203. In the example shown in FIG. 10, the driving element 202 is an NMOS transistor, the driving element 203 is a PMOS transistor, and the energy applying unit 101 is arranged between the driving elements 202 and 203. FIG. 11 shows the layout of the semiconductor device 200. The semiconductor device 200 is typically formed on a semiconductor substrate such as a silicon substrate by using a multilayer wiring technique. A plurality of driving portions DRV are arranged along a straight line A between a power supply terminal 106 and ground terminal 107. A plurality of control circuits 103 are also arranged along the straight line A between the power supply terminal 106 and ground terminal 107.

A power supply line 104 is, for example, a metal line (which can be made of a metal such as an aluminum alloy) of a second layer, and can be formed to extend over the driving elements 202 and 203. The power supply line 104 extends along the straight line A from the power supply terminal 106, and applies a power supply voltage to the plurality of driving portions DRV. A ground line 105 is a metal line (which can be made of a metal such as an aluminum alloy), and can be formed to extend over the control circuits 103. The ground line 105 extends along the straight line A from the ground terminal 107, and applies a ground voltage to the plurality of driving portions DRV. The power supply line 104 and ground line 105 typically have a predetermined thickness. The power supply terminal 106 is arranged on one side of the array of the plurality of driving portions DRV, and the ground terminal 107 is arranged on the other side of the array of the plurality of driving portions DRV.

In the example shown in FIG. 11, the power supply line 104 is connected to the power supply terminal 106 formed at the left end, and the ground line 105 is connected to the ground terminal 107 formed at the right end.

Figure 12:
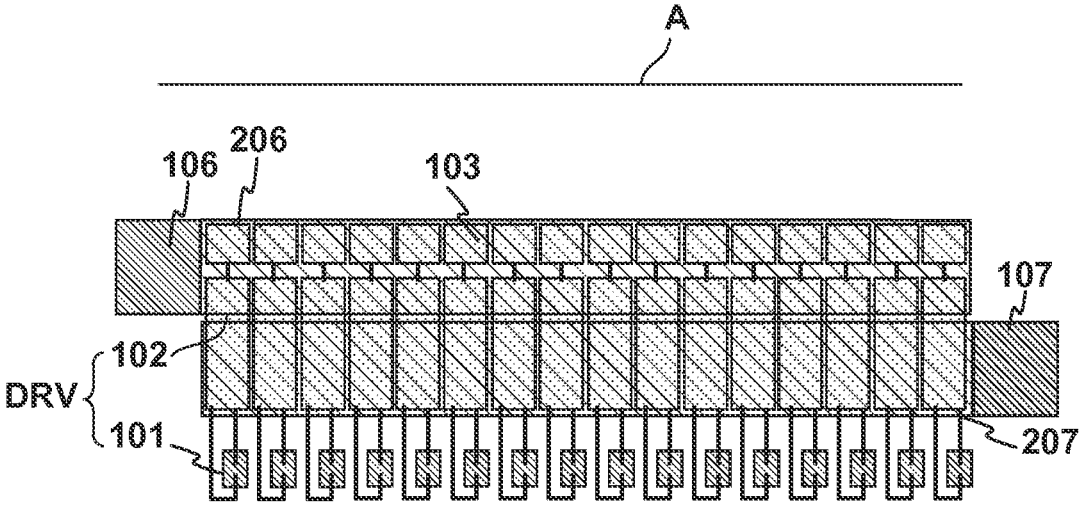
FIG. 12 is a view showing a comparative example for the second embodiment of the present invention.

FIG. 12 shows a comparative example for the second embodiment. A driving portion DRV including an energy applying unit 101 and driving elements 202 and 203, a control circuit 103, a power supply terminal 106, and a ground terminal 107 are the same as those shown in FIG. 11. This comparative example differs from the second embodiment shown in FIG. 11 in that the width of each of a power supply line 206 and ground line 207 in a direction perpendicular to the straight line A is constant.

To compare the characteristics of the power supply line 104 of the second embodiment shown in FIG. 11 with those of the power supply line 206 of the comparative example shown in FIG. 12, the specifications of the power supply line will exemplarily be described below. In the exemplary specifications, the wiring resistance of the power supply lines 104 and 206 is 0.1Ω/□, an electric current flowing through each energy applying unit 101 is 0.1 A, the arrangement intervals between the energy applying units 101 is 50 μm, and the total number of the energy applying units 101 is 16. Also, in the exemplary specifications, the power supply line 104 has a trapezoidal shape having a line width of 150 μm on the side of the power supply terminal 106, a line width of 100 μm in the central portion, and a line width of 50 μm on the side of the ground terminal 107. The power supply line 206 has a rectangular shape having a line width of 100 μm.

Of the plurality of driving portions DRV, the driving portion DRV arranged in a position farthest from the power supply terminal 106 has the largest voltage drop amount at a power supply side terminal (a drop amount from the voltage of the power supply terminal 106). Also, this voltage drop amount at the power supply side terminal of the driving portion DRV arranged in the position farthest from the power supply terminal 106 is largest when electric currents are supplied to all of the 16 driving portions DRV. In the following description, the voltage drop amount at the power supply side terminal of the driving portion DRV arranged in the position farthest from the power supply terminal 106 when electric currents are supplied to all of the 16 driving portions DRV will be called a maximum voltage drop amount. The maximum voltage drop amount in the power supply line 104 of the second embodiment is 0.62 V, and that in the power supply line 206 of the comparative example is 0.68 V. Thus, the maximum voltage drop amount in the power supply line 104 of the second embodiment is reduced to 91.2% of that in the power supply line 206 of the comparative example.

The ground line 105 of the second embodiment and the ground line 207 of the comparative example will be compared below under the above-described exemplary specifications. Of the plurality of driving portions DRV, the driving portion DRV arranged in a position farthest from the ground terminal 107 has the largest voltage rise amount at a ground side terminal (a rise amount from the voltage of the ground terminal 107). Also, this voltage rise amount at the ground side terminal of the driving portion DRV arranged in the position farthest from the ground terminal 107 is largest when electric currents are supplied to all of the 16 driving portions DRV. In the following description, the voltage rise amount at the ground side terminal of the driving portion DRV arranged in the position farthest from the ground terminal 107 when electric currents are supplied to all of the 16 driving portions DRV will be called a maximum voltage rise amount. The maximum voltage rise amount in the ground line 105 of the second embodiment is 0.62 V, and that in the ground line 207 of the comparative example is 0.68 V. Thus, the maximum voltage rise amount in the ground line 105 of the second embodiment is reduced to 91.2% of that in the ground line 207 of the comparative example.

Figure 13:
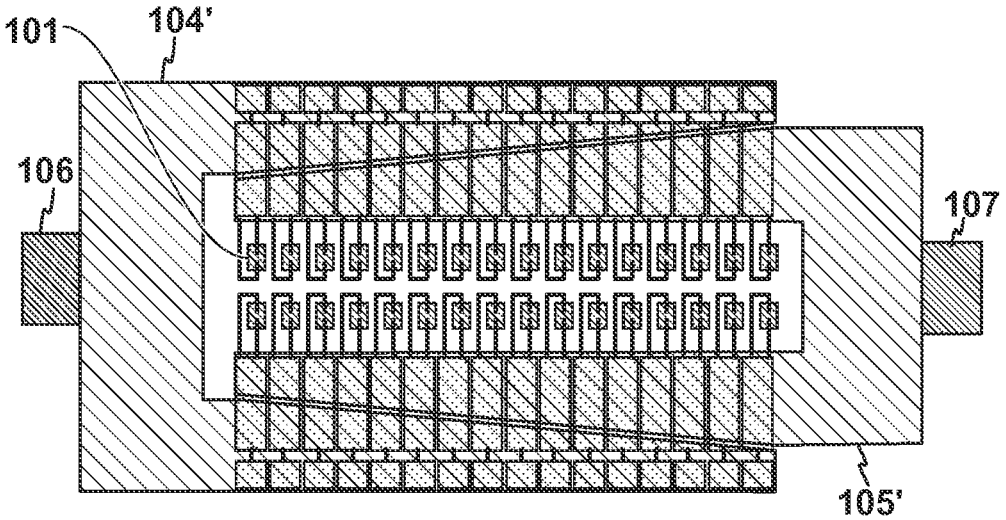
FIG. 13 is a view showing the layout of a semiconductor device of a modification of the second embodiment of the present invention.

FIG. 13 shows a layout example advantageous for increasing the number of energy applying units 101. In this example shown in FIG. 13, the arrangement shown in FIG. 11 is symmetrically laid out with respect to a straight line. Thus, the power supply line 104 is changed into a power supply line 104' having a shape connecting two power supply lines 104 symmetrically arranged with respect to a straight line. Similarly, the ground line 105 is changed into a ground line 105' having a shape connecting two ground lines 105 symmetrically arranged with respect to a straight line. This arrangement can increase the number of energy applying units without increasing the number of power supply terminal 106 and the number of ground terminal 107.

A printing head (liquid discharge head), printing head cartridge (liquid discharge head cartridge), and inkjet printing apparatus (printing apparatus) incorporating the semiconductor device as described above will exemplarily be explained below.

Figure 14:
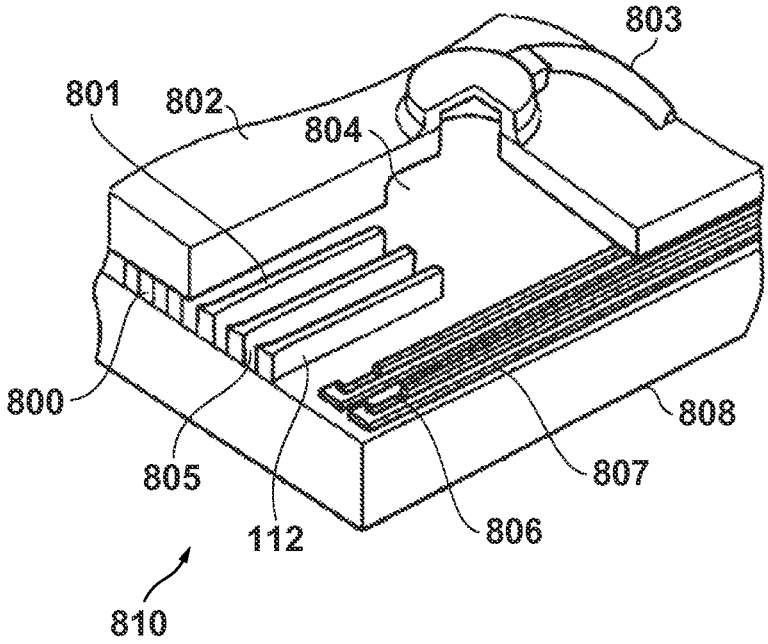
FIG. 14 is a perspective view showing details of the arrangement of an inkjet printing head.

FIG. 14 shows the main parts of a printing head 810 including an inkjet printing head substrate 808 incorporating the semiconductor device exemplarily explained through the first and second embodiments. Referring to FIG. 14, the above-described energy applying unit 101 is drawn as a heat generating unit 806. As shown in FIG. 14, the substrate 808 can form the printing head 810 by assembling liquid channel wall members 801 for forming liquid channels 805 communicating with a plurality of orifices 800, and a top plate 802 having an ink supply port 803. In this structure, ink injected from the ink supply port 803 is stored in an internal common ink chamber 804, supplied to each liquid channel 805, and discharged from the orifice 800 by driving the substrate 808 and heat generating unit 806 in this state.

Figure 15:
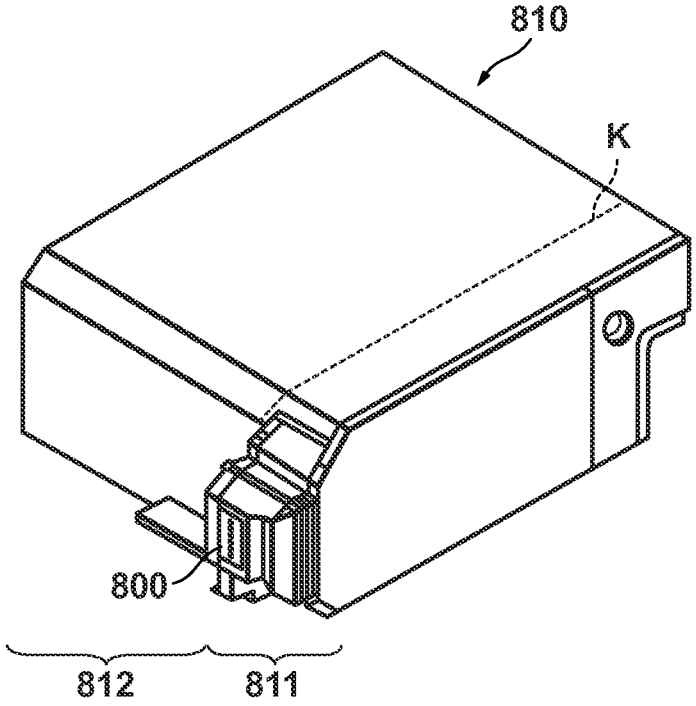
FIG. 15 is a perspective view showing an inkjet printing head configured as an inkjet printing cartridge.

FIG. 15 is a view showing the overall arrangement of the inkjet printing head 810 as described above. The inkjet printing head 810 includes a printing head unit 811 having the plurality of orifices 800 described above, and an ink tank 812 for holding ink to be supplied to the printing head unit 811. The ink tank 812 is attached to the printing head unit 811 so as to be detachable from a boundary line K. The inkjet printing head 810 has an electrical contact (not shown) for receiving an electrical signal from the carriage side when mounted in a printing apparatus shown in FIG. 16, and a heater is driven by this electrical signal. The ink tank 812 contains fibrous or porous ink absorbers for holding ink, and ink is held by these ink absorbers.

An inkjet printing apparatus capable of realizing high-speed printing and high-image-quality printing can be provided by attaching the printing head 810 shown in FIG. 15 to an inkjet printing apparatus main body, and controlling a signal to be applied from the apparatus main body to the printing head 810. The inkjet printing apparatus using the printing head 810 will be explained below.

Figure 16:
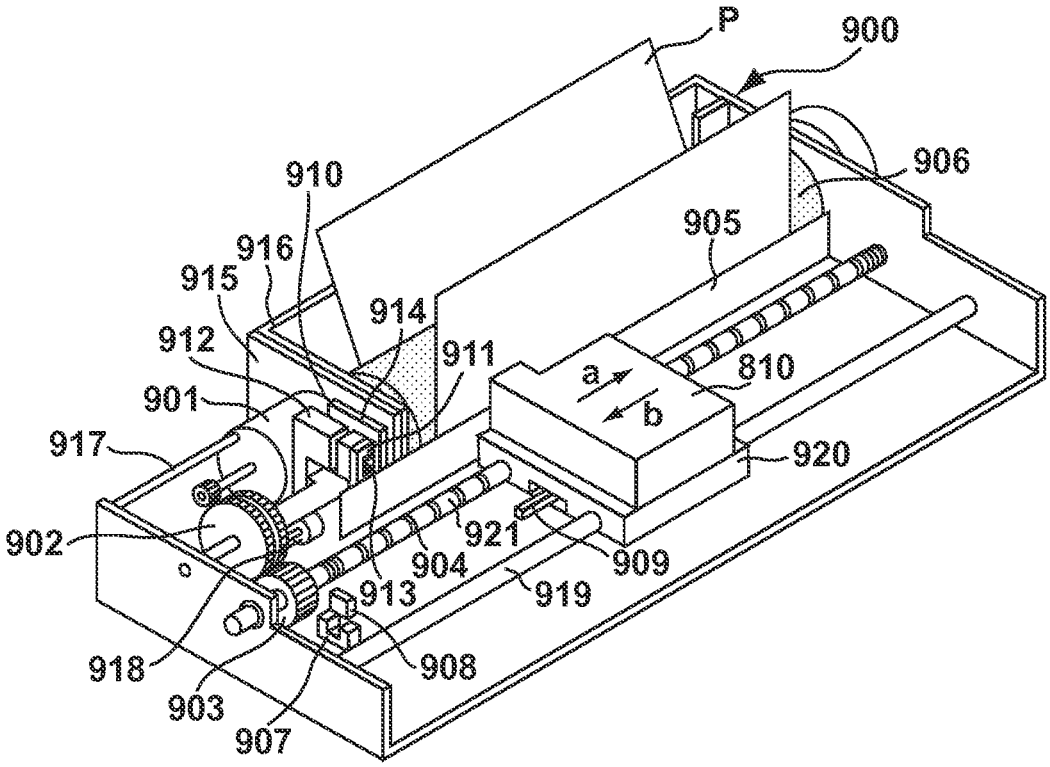
FIG. 16 is a perspective view showing the outer appearance of an inkjet printing apparatus.

FIG. 16 is a perspective view showing the outer appearance of an inkjet printing apparatus 900 of an embodiment according to the present invention. Referring to FIG. 16, the printing head 810 is mounted on a carriage 920 that engages with a spiral groove 904 of a lead screw 921 that rotates in synchronism with the forward-reversal rotation of a driving motor 901 via driving force transmission gears 902 and 903. The printing head 810 can move back and forth together with the carriage 920 along a guide 919 in the directions of arrows a and b by the driving force of the driving motor 901. A paper pressing plate 905 for print paper P conveyed onto a platen 906 by a print medium supply device (not shown) presses the print paper P against the platen 906 along the carriage moving direction.

Photocouplers 907 and 908 are home position detecting means for detecting, in a region where the photocouplers 907 and 908 are formed, the existence of a lever 909 of the carriage 920, and, for example, switching the rotational directions of the driving motor 901. A support member 910 supports a cap member 911 for capping the entire surface of the printing head 810. A suction means 912 sucks the interior of the cap member 911, thereby performing suction recovery of the printing head 810 through a cap opening 913. A moving member 915 makes a cleaning blade 914 movable forward and backward. A main body support plate 916 supports the cleaning blade 914 and moving member 915. The cleaning blade 914 need not be the form shown in FIG. 16, and it is, of course, also possible to apply a well-known cleaning blade to this embodiment. A lever 917 is formed to start the suction of the suction recovery, and moves in synchronism with the movement of a cam 918 that engages with the carriage 920, thereby controlling the driving force from the driving motor 901 by a known transmitting means such as clutch switching. A printing controller (not shown) for applying a signal to the heat generating unit 806 formed in the printing head 810 and controlling the driving of the mechanisms such as the driving motor 901 is formed in the apparatus main body.

In the inkjet printing apparatus 900 having the arrangement as described above, the printing head 810 performs printing on the print paper P conveyed onto the platen 906 by the print medium supply device, by moving back and forth over the entire width of the print paper P. The printing head 810 can perform high-accuracy, high-speed printing because it is manufactured by using the inkjet printing head substrate having the circuit structure of each embodiment described above.

Figure 17:
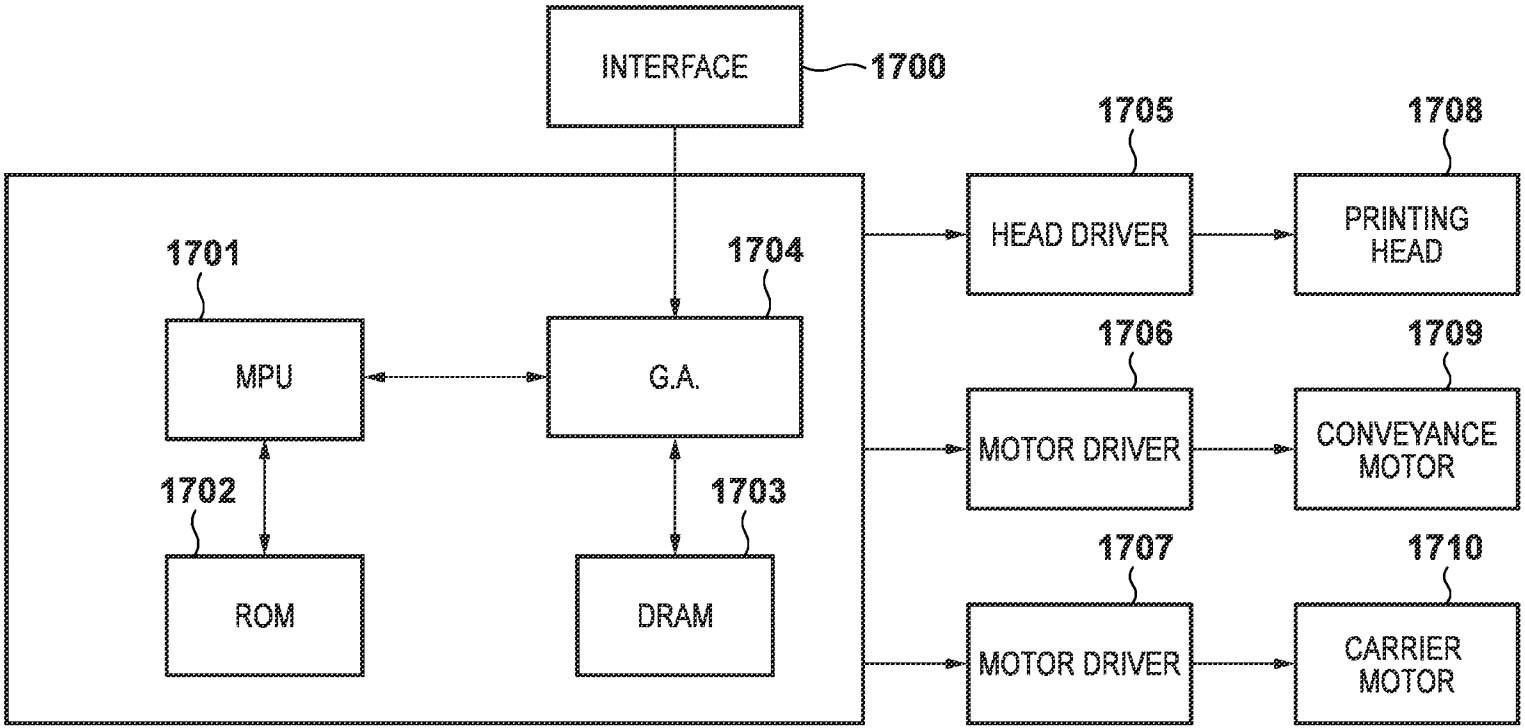
FIG. 17 is a block diagram showing the configuration of a control circuit of the inkjet printing apparatus.

Next, the configuration of the control circuit for controlling the printing of the above-described apparatus will be explained. FIG. 17 is a block diagram showing the configuration of the control circuit of the inkjet printing apparatus 900. This control circuit includes an interface 1700 for receiving a print signal, an MPU (microprocessor) 1701, and a program ROM 1702 for storing a control program to be executed by the MPU 1701. The control circuit also includes a dynamic RAM (Random Access Memory) 1703 for saving various kinds of data (for example, the above-mentioned print signal and print data to be supplied to the head), and a gate array 1704 for controlling the supply of print data to a printing head 1708. The gate array 1704 also controls data transfer between the interface 1700, MPU 1701, and RAM 1703. The control circuit further includes a carrier motor 1710 for carrying the printing head 1708, and a conveyance motor 1709 for conveying print paper. In addition, the control circuit includes a head driver 1705 for driving the head 1708, and motor drivers 1706 and 1707 for respectively driving the conveyance motor 1709 and carrier motor 1710.

The operation of the above-mentioned control configuration is as follows. When a print signal enters the interface 1700, the print signal is converted into print data for printing between the gate array 1704 and MPU 1701. Then, the motor drivers 1706 and 1707 are driven, and the printing head is driven in accordance with the print data supplied to the head driver 1705, thereby printing the data.

The present invention achieves a remarkable effect in a printing head and printing apparatus using particularly a method of discharging ink by using thermal energy, which is advocated by the present applicant among other inkjet printing methods. The present invention is usable in, for example, a printer, copying apparatus, and facsimile apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-247750, filed Nov. 9, 2012, which is hereby incorporated by reference herein in its entirety.

What is claimed is:

1. A semiconductor device configured to control discharge of a liquid, the device comprising:

a power supply terminal;

a ground terminal;

a plurality of driving portions arranged along a straight line between the power supply terminal and the ground terminal and configured to operate to discharge a liquid;

a power supply line extending parallel to the straight line from the power supply terminal and configured to supply a power supply voltage to the plurality of driving portions; and a ground line extending parallel to the straight line from the ground terminal and configured to supply a ground voltage to the plurality of driving portions, wherein a width of the power supply line in a direction perpendicular to the straight line decreases away from the power supply terminal within a range in which the plurality of driving portions are arranged, and a width of the ground line in the direction decreases away from the ground terminal within the range.

2. The device according to claim 1, wherein a sum total of the width of the power supply line in the direction and the width of the ground line in the direction is constant within the range.

3. The device according to claim 2, wherein when the power supply line within the range is divided into N power supply line blocks arranged parallel to the straight line, and the ground line within the range is divided into N ground line blocks arranged parallel to the straight line, a representative value of a width in the direction of an ith power supply line block from a side of the ground terminal is $a_i$, and a width in the direction of a power supply line block arranged in a central portion of the N power supply line blocks is 1, a representative value of a width in the direction of a jth ground line block from a side of the power supply terminal is $b_j$, and a representative value of a width in the direction of a ground line block arranged in a central portion of the N ground line blocks is 1, and the N power supply line blocks and the N ground line blocks are arranged such that the ith power supply line block and an (N+1−i)th ground line block are adjacent to each other, $$1+(i-j)/(i+j)<a_i<1 \text{ and } 1<b_j<1+(-i+j)/(i+j)$$

are satisfied between the ground terminal and the power supply line block arranged in the central portion, and between the ground terminal and the ground line block arranged in the central portion, and $$1<a_i<1+(i-j)/(i+j) \text{ and } 1+(-i+j)/(i+j)<b_j<1$$

are satisfied between the power supply line block arranged in the central portion and the power supply terminal, and between the ground line block arranged in the central portion and the power supply terminal.

4. The device according to claim 3, wherein each of the plurality of power supply line blocks and each of the plurality of ground line blocks are arranged to operate at least one driving portion.

5. The device according to claim 3, wherein a, is an average value of the widths of the power supply line blocks in the direction, and $b_j$ is an average value of the widths of the ground line blocks in the direction.

6. A liquid discharge head comprising:

an orifice configured to discharge a liquid; and the semiconductor device as defined in claim 1 and arranged to control the discharge of the liquid from the orifice.

7. A liquid discharge head cartridge comprising:

the liquid discharge head as defined in claim 6; and a tank configured to hold a liquid supplied to the liquid discharge head.

8. A printing apparatus comprising the liquid discharge head cartridge as defined in claim 7.

9. The device according to claim 1, wherein the width of the power supply line decreases at a constant rate in a direction away from the power supply terminal.

10. The device according to claim 1, wherein the width of the ground line decreases at a constant rate in a direction away from the ground terminal.

11. The device according to claim 1, wherein the width of the power supply line decreases stepwisely in a direction away from the power supply terminal.

12. The device according to claim 1, wherein the width of the ground line decreases stepwisely in a direction away from the ground terminal.

* * * * *